United States Patent [19]

Watanabe

[11] Patent Number: 4,979,423

[45] Date of Patent: Dec. 25, 1990

[54] TOUCH RESPONSE DEVICE FOR ELECTRONIC MUSICAL INSTRUMENT

[75] Inventor: Keisuke Watanabe, Hamamatsu, Japan

[73] Assignee: Yamaha Corporation, Hamamatsu, Japan

[21] Appl. No.: 306,779

[22] Filed: Feb. 3, 1989

[30] Foreign Application Priority Data

Feb. 4, 1988 [JP] Japan ..... 63-25013

[51] Int. Cl.[5] ..... G10H 1/055

[52] U.S. Cl. ..... 84/690; 84/DIG. 7; 338/69; 341/27; 341/34

[58] Field of Search ..... 84/1.01, 1.09–1.13, 84/1.19–1.27, DIG. 7, 615, 626–633, 658, 662–665, 690, 701–711; 338/69; 333/186; 341/22, 26, 27, 34

[56] References Cited

U.S. PATENT DOCUMENTS 3,784,935 1/1974 Pearlman et al. ..... 333/186
4,194,425 3/1980 Kitagawa ..... 84/1.01
4,528,885 7/1985 Chihana ..... 84/1.1
4,558,623 12/1985 Buchla ..... 84/1.1

*Primary Examiner*—Stanley J. Witkowski
*Attorney, Agent, or Firm*—Spensley Horn Jubas & Lubitz

[57] ABSTRACT

A touch response device for an electronic musical instrument includes pressure detector for detecting initial-touch and after-touch of a key. The pressure detector means has two or more response stages that have different response characteristics to key pressure variation. An initial-touch-detector signal is produced when the pressure detecting means is in a first response stage among the response stages, and after-touch-detector signal is produced when the pressure detecting means is in a second response stage among the response stages. According to the invention, initial-touch signal and after-touch signal are generated by the use of one common operation-detector signal produced from the pressure detector means. As a result, the construction of the pressure detecting means is much simplified compared with a conventional touch-response device provided with two separate detectors, one of which detects initial-touch and another of which detects after-touch.

7 Claims, 4 Drawing Sheets

TOUCH-RESPONSE-DETECTION-SIGNAL-GENERATING CIRCUIT

CONSTRUCTION OF PRESSURE DETECTING MEANS

OUTPUT RESPONSE CHARACTERISTICS OF PRESSURE DETECTOR

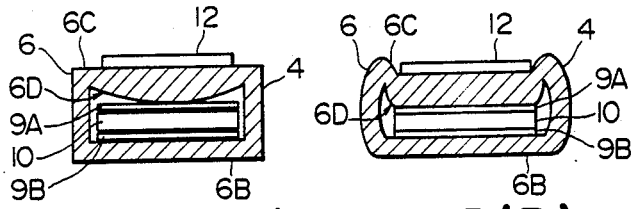
FIG. 3(A) FIG. 3(B)
DEFORMATION OF HOLDER
FIG. 5(A)
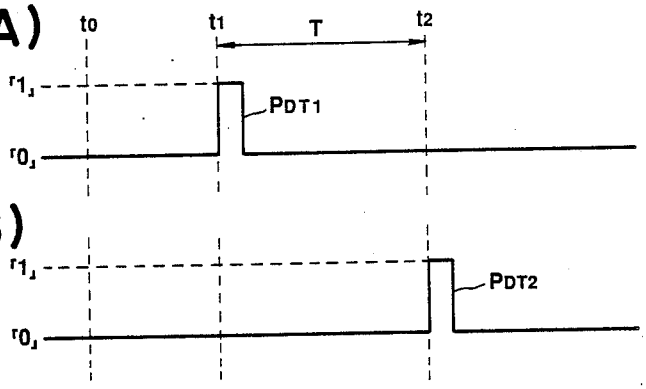
FIG. 5(B)
DETECTION OF KEY VELOCITY

SECOND EMBODIMENT

TOUCH RESPONSE DEVICE FOR ELECTRONIC MUSICAL INSTRUMENT

BACKGROUND OF THE INVENTION

1. Field of the Invention

This invention relates to a touch response device for an electronic musical instrument of simplified construction.

2. Prior Art

An electronic musical instrument provided with a touch response device is disclosed in the Japanese Pat. Publication No. 59-105692. This touch response device comprises initial-touch-response means and after-touch-response means. The initial-touch-response means controls such parameters as volumes, pitches, tones, etc., of musical tones generated by key depressions, according to elapsed time from the beginning of a key depression to on-timing of a key switch. In contrast, the after-touch-response means controls these parameters according to key pressure of each key operation.

This type of musical instrument can cause initial-touch effects and after-touch effects for every key depression, and hence, more delicate and expressive musical tones are produced.

The conventional touch-response device, however, is of complex construction, includes many components, and hence is of high cost because the initial-touch-response means and the after-touch-response means are separately provided.

SUMMARY OF THE INVENTION

It is therefore an object of the invention to provide a touch response device for an electronic musical instrument which generates initial-touch-detection output and after-touch-detection output with simple construction.

According to the present invention, there is provided a touch response device for an electronic musical instrument comprising:

pressure detecting means having two or more response stages that have different response characteristics to key pressure variation and producing key-operation-detecting signal according to the response stages;

initial-touch-detection-signal-generating means for generating initial-touch-detection signal when the pressure detecting means is in the first response stage among the response stages; and after-touch-detection-signal-generating means for generating after-touch-detection signal when the pressure detecting means is in the second response stage among the response stages.

BRIEF DESCRIPTION OF THE DRAWINGS

FIGS. 3A and 3B is a partial sectional view of the operation of the pressure detector;

FIGS. 5A and 5B is a timing chart of waveforms to explain key velocity detection.

DESCRIPTION OF THE PREFERRED EMBODIMENTS

The invention will now be described with reference to the accompanying drawings.

[A] FIRST EMBODIMENT

Figure 1:
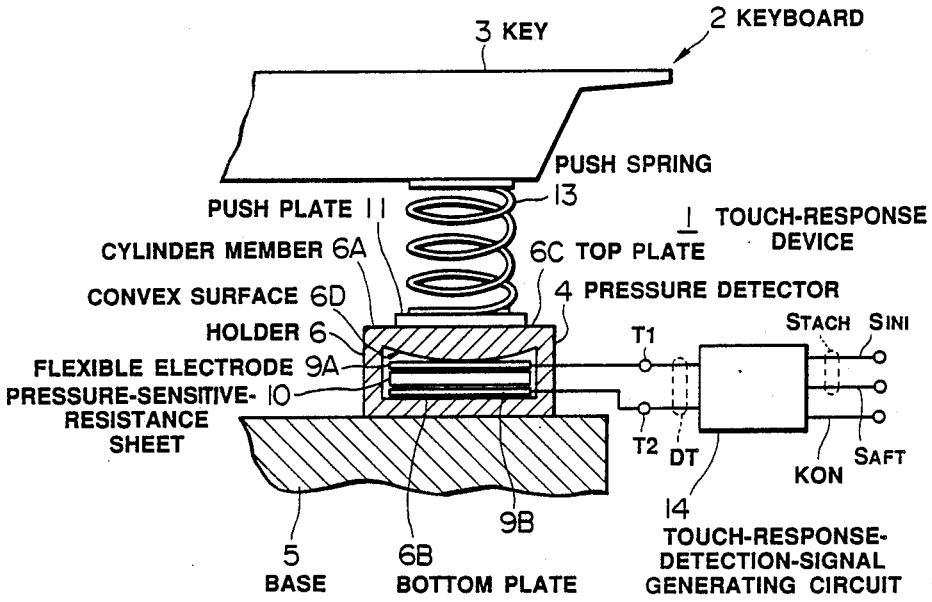
FIG. 1 is a longitudinal section of the construction of the main part of a touch-response device for an electronic musical instrument according to a first embodiment of the present invention.

In FIG. 1, numeral 1 designates a touch-response device provided with pressure detectors 4, each of which is placed under a key 3 of a keyboard 2, and which is fixed to a base 5. The pressure detector 4 has an hollow holder 6 made of rubber. The holder 6 comprises a hollow cylinder member 6A which is enclosed in both ends by a top plate 6C and a bottom plate 6B.

Inside the holder 6, a pair of flexible electrodes 9A and 9B, with a pressure-sensitive-resistance sheet 10 between them, are provided so that they form three layers. The pressure-sensitive-resistance sheet 10 is made up of pressure sensitive ink, for example. The top plate 6C has a convex inner surface 6D, and is provided with round push plate 11 thereon. Between the push plate 11 and the bottom surface of the key 1, a push spring 13 is inserted.

The flexible electrodes 9A and 9B are connected to a touch-response-detection-signal-generating circuit 14 via output terminals T1 and T2. Hence, a voltage across the flexible electrodes 9A and 9B is applied to the touch-response-detection-signal-generating circuit 14 as operation-detection signal DT.

Figure 2:
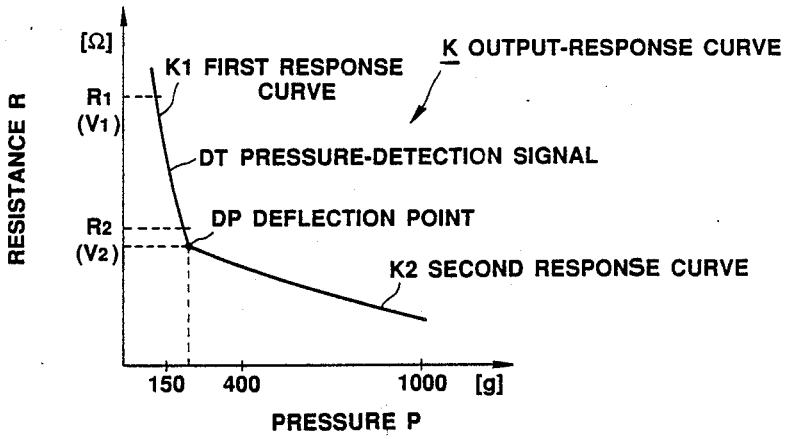
FIG. 2 is a graph showing an output-response curve characteristic of the pressure detector in FIG. 1.

The touch-response-detection-signal-generating circuit 14 is designed to output touch-response-detection signals $S_{TACH}$ consisting of an initial-touch signal $S_{INI}$ and an after-touch signal $S_{AFT}$, by using the output response characteristic shown in FIG. 2. This output response curve, showing the relationship between pressure exerted to the pressure detector 4 when the key 3 is depressed and resistance across output terminals T1 and T2, consists of two sections in which resistance varies significantly according to pressure.

To be more specific, when the key 3 is released, the pressure exerted on the top plate 6C of the holder 6 through the push spring 13 and push plate 11 is less, and the top plate 6C resumes its undistorted inner convex shape. In this case, a convex surface 6D of the top plate 6C exerts little pressure upon flexible electrode 9A. Hence, contact resistance between inner surfaces of a pair of flexible electrodes 9A and 9B and the pressure-sensitive sheet 10 can be sustained at a sufficiently high level.

Under such conditions, when the key 3 is depressed, the push spring 13, being compressed, exerts pressure on top plate 6C via push plate 11. Top plate 6C is deformed when the convex surface 6D is depressed and thereby presses on flexible electrode 9A.

Thus, pressure from the key 3 is transmitted to the flexible electrode 9A via the top plate 6C; and the flexible electrodes 9A and 9B pinch the pressure-sensitive sheet 10 between the top plate 6C and the bottom plate 6B. This pinching causes the convex surface 6D to deform, hence increasing the contact area between the convex surface 6D and flexible electrode 9A. As the contact area increases, the contact resistance between the flexible electrodes 9A and 9B and the pressure-sensitive-resistance sheet 10 sharply decreases as shown by the first response curve K1 in FIG. 2. This causes the decrease in resistance R across the output terminals T1 and T2, i.e., the value of operation-detecting signal DT.

In the course of these processes, the top plate 6C changes its form as shown in FIGS. 3A and 3B: the convex surface 6D maintains its initial form before pressure is exerted as shown FIG. 3 (A), gradually changes shape as more pressure is applied, and finally is maximally deformed as shown in FIG. 3 (B).

Once key 3 is depressed to the maximum determined by the convex surface 6D, further depression of key 3 causes no increase in the contact area between the convex surface 6D and the flexible electrode 9A. Hence, the sharp decrease in resistance, and the operation-detecting signal DT, caused by the increase in the contact area, terminates as shown by the deflection point DP in FIG. 2. Subsequently, an increase in pressure on the key 3 is transmitted to the pressure-sensitive-resistance sheet 10 via the push spring 13, push plate 11, top plate 6C, and the flexible electrode 9A, causing gradual resistance variation.

Specifically, the pressure-sensitive-resistance sheet 10 gradually decreases its resistance as shown by the second response curve in FIG. 2, according to the pressure changes on the key 3. This is detected as the decrease in the resistance R across the output terminal T1 and T2, i.e., the decrease of the operation-detecting signal DT.

Figure 4:
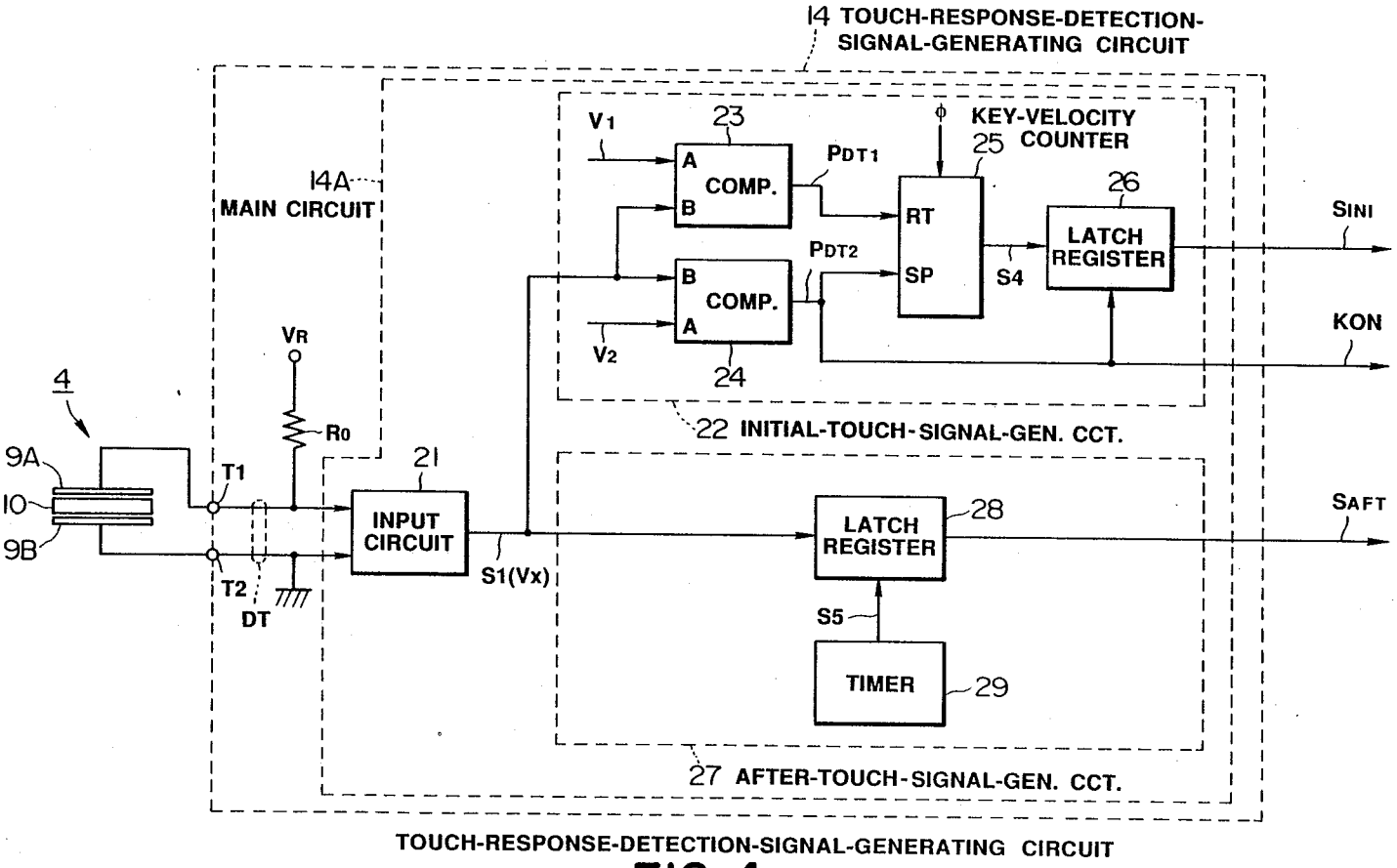
FIG. 4 block diagram of the configuration of a touch-response-detection-signal-generating circuit in FIG. 1.

The operation-detecting signal DT is generated by the touch-response-detection-signal-generating circuit 14 shown in FIG. 4. In this circuit 14, the output terminal T1 is connected to a reference voltage VR through a resistor RO, and the output terminal T2 is grounded. Thus, the resistor RO and the resistance R across the terminals T1 and T2 form a voltage divider that produces the operation-detecting signal DT between the terminals T1 and T2, and applies it to an input circuit 21 in a main circuit 14A.

The input circuit 21 consists of an analog-to-digital converter and supplies the output thereof as operation-detecting data S1 to input terminals B of comparators 23 and 24 in an initial-touch-signal-generating circuit 22.

The comparators 23 and 24 are applied reference voltages V1 and V2, respectively, at reference-input terminals thereof. These reference voltages are expressed as follows:

$$V1 = R1 \cdot VR/(R0+R1) \quad (1)$$

$$V2 = R2 \cdot VR/(R0+R1) \quad (2)$$

Where R1 and R2 are resistances values shown in FIG. 2. They are selected so that the resistance R1 takes a rather high value on the first response curve K1, while the resistance R2 takes a lower value near the deflection point DP. As described above, the pressure detector 4 has two-stage-output characteristic specified by the first and second response curves K1 and K2 that sharply change slopes at the deflection point DP.

When key 3 is not depressed, voltage Vx of the operation-detecting data S1 is higher than the reference voltages V1 and V2, because the resistance R of the pressure detector 4 is much larger than the resistance R1 as shown in FIG. 2. As a result, the outputs of comparators 23 and 24, respectively, become "0" level in logical representation.

Conversely, when key 3 is depressed, the resistance R of the pressure detector 4 decreases along the first response curve K1, causing comparators 23 and 24 to produce the detection pulses $P_{DT1}$ and $P_{DT2}$ shown in FIG. 5 (A) and (B), at the time when resistance R sequentially passes the resistances R1 and R2, taking lower values than these resistances R1 and R2, respectively.

In FIG. 5, depression of key 3 begins at time tO, the detection pulse $P_{DT1}$ is generated at time t1, and the detection pulse $P_{DT2}$ is produced at time t2. Thus, time T between the time t1 and t2 indicates the velocity of key 3.

The detection pulses $P_{DT2}$ and $P_{DT2}$ are applied to the reset terminal RT and the count-stop terminal SP of key-velocity counter 25, respectively. The key-velocity counter 25 begins counting clock pulse Φ when the detection pulse $P_{DT1}$ is applied, and stops the counting when detection pulse $P_{DT2}$ is applied thereto. Thus, a key-velocity-detection signal S4 is obtained from the output terminal of key-velocity counter 25, and is supplied to latch register 26.

The latch register 26, receiving the detection pulse $P_{DT2}$ from the comparator 24 as a latch signal, loads the key-velocity-detection signal S4 by the detection pulse $P_{DT2}$, and outputs the detection signal S4 as an initial-touch-detection signal $S_{INI}$ from the touch-response-detection-signal-generating circuit 14.

The operation-detecting data S1 is also applied to latch register 28 in an after-touch-signal-generating circuit 27, and is loaded to the latch register 28 by timer-interrupt signal S5 supplied thereto periodically from timer 29. The latch register 28 outputs the operation-detecting data S1 from the touch-response-detection-signal-generating circuit 14 as an after-touch-detection signal $S_{AFT}$. Finally, the detection pulses $P_{DT2}$ from the comparator 24 is provided as a key-on signal KON.

In the construction described above, when a performer depresses key 3, it in turn presses the push spring 13. Being compressed, the push spring 13 depresses the pressure detector 4 so that the resistance of pressure detector 4 decreases along the first response curve K1. After push spring 13 is depressed to its limit, resistance R of the pressure detector 4 varies along the second response curve K2 according to the pressure exerted thereon by key 3.

When a force exerted by the push spring 13 is small compared to the pressure exerted thereon by key 3, (for example, the force exerted by the push spring is between 100 and 150 grams, whereas the pressure exerted thereon by the performer is between 400 and 1000 grams), the performer can depress the key 3 lightly, as long as the push spring 13 is not compressed to its limit, and the resistance of the pressure detector 4 varies along the first response curve K1. Hence, the performer can freely control the key velocity, that is, the elapsed time in which the resistance R of the pressure detector 4 changes from the first reference value R1 to the second reference value R2. During this process, the touch-response-detection-signal-generating circuit 14 sends out the initial-touch-detection signal $S_{INI}$ from the initial-touch-signal-generating circuit 22.

In addition, when the performer controls the key depression after the push spring 13 has reached its compression limit, the pressure exerted on key 3 is detected by pressure detector 4. This causes the after-touch-signal-generating circuit 27 in the touch-response-detection-signal-generating circuit 14 to produce the after-touch signal $S_{AFT}$ every time the timer-interrupt signal occurs.

According to the construction described above, the initial-touch-detection signal $S_{INI}$ and after-touch-detection signal $S_{AFT}$, each corresponding to initial-touch operation and after-touch operation, respectively, are generated by the use of one common operation-detecting signal S1 produced from the pressure detector 4. As a result, the construction of the embodiment becomes much simpler compared with a conventional touch-response device provided with two separate detectors each of which detects initial-touch and after-touch, respectively.

[B] SECOND EMBODIMENT

The first embodiment described above has a touch-response-detection-signal-generating circuit 14 for every pressure detector 4 provided for each key 3. The second embodiment, however, reduces the number of the touch-response-detection-signal-generating circuits to that of the twelve notes in an octave.

Figure 6:
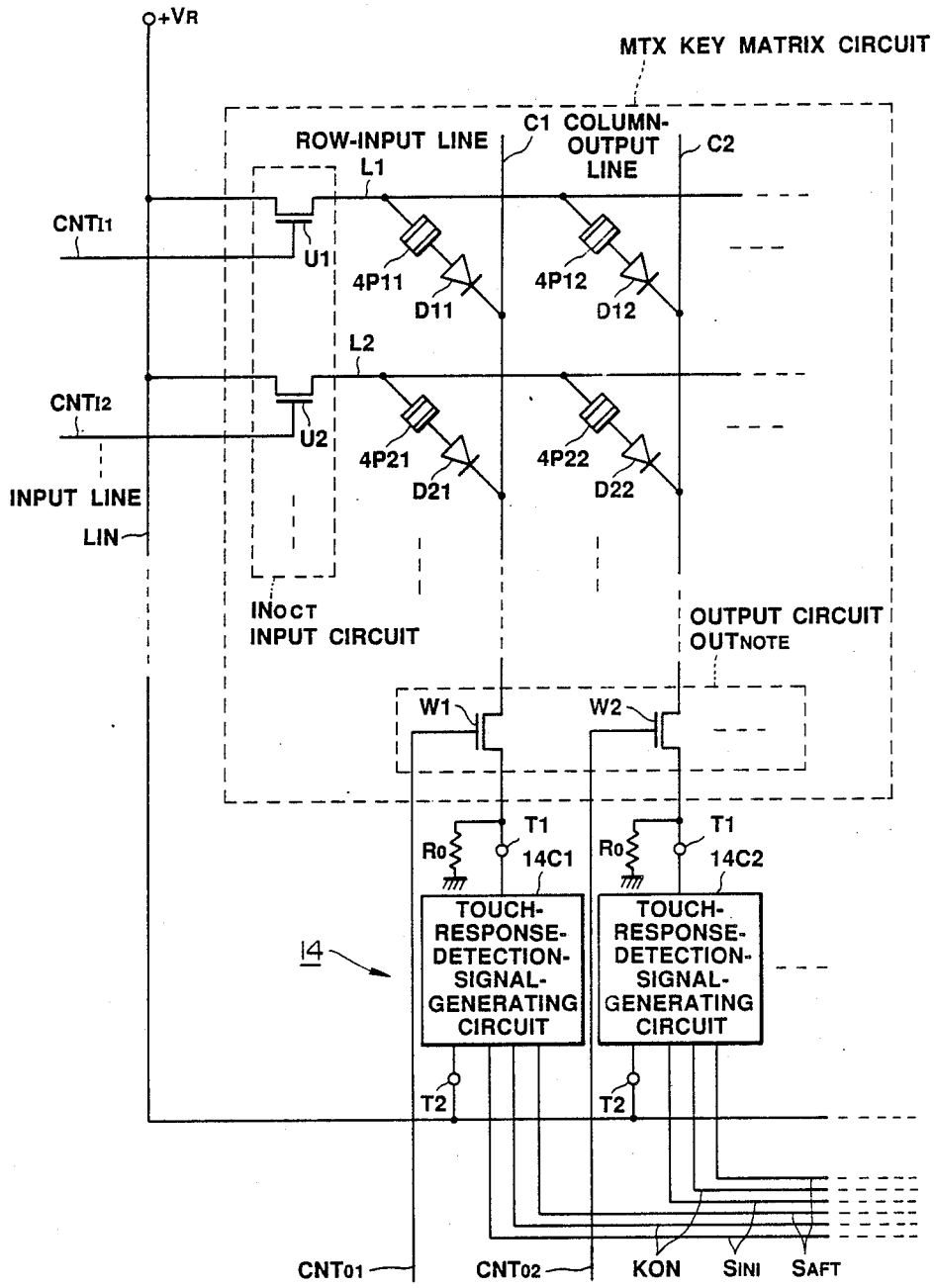
FIG. 6 a block diagram of the configuration of a second embodiment of the invention.

FIG. 6 shows an arrangement of the main portion of the second embodiment. A key-matrix circuit MTX includes row-input lines L1, L2, . . . , column-output lines C1, C2, . . . , and pressure detectors 4P11, 4P12, . . . , 4P21, 4P22, . . . connected to row-input and column-output lines at each cross point thereof through diodes D11, D12, . . . , D21, D22, . . . . The number of pressure detectors connected to one row-input line (that is, the number of column-output lines) is equal to the number of notes in an octave, i.e., 12, and the number of row-input lines is equal to that of the number of octaves in the keyboard e.g., 8.

Each column-output line C1, C2, . . . is grounded through each of the analog switches W1, W2, . . . in an output circuit OUTnote, and each of resistors R0. These switches W1, W2, . . . are provided for each note in the octave. Touch-response-detection-signal-generating circuits 14C1, 14C2, . . . which are practically the same as the circuit 14 shown in FIG. 14, are also provided for each of the notes in an octave, and T1 terminals thereof are grounded through resistors R0. On the other hand, T2 terminals thereof are connected in common to the reference voltage VR through an input line LIN. The input line LIN is also connected to each row-input line L1, L2, . . . through analog switches U1, U2, . . . of an input circuit INoct.

These switches U1, U2, . . . and W1, W2, . . . are controlled by control signals supplied thereto. Every key state on the keyboard (61 keys, for example) is detected by scanning, and the information thereof is presented in the scanning time slot assigned to each key. The information presents input control signals CNTI1, CNTI2, . . . that designate the octave to which an operated key belongs, and control signals CNTO1, CNTO2, . . . that designate the note of the key in the octave. The input control signals CNTI1, CNTI2, . . . are applied to control terminals of the switches U1, U2, . . . , respectively, whereas the control signals CNTO1, CNTO2, . . . are applied to control terminals of the switches W1, W2, . . . , respectively.

Thus, the pressure-detecting signals DT produced from the pressure detectors 4P11, 4P12, . . . 4P21, 4P22, . . . , provided for each key are sequentially entered into the touch-response-detection-signal-generating circuit 14C1, 14C2, . . . .

The initial-touch-signal-generating circuit 22 and after-touch-signal-generating circuit 27 (see FIG. 4) in each of the touch-response-detection-signal-generating circuit 14C1, 14C2, . . . are designed to form and store the key velocity data and after-touch data of the corresponding notes in different octaves, in a time-sharing fashion.

According to the second embodiment, much simpler construction can be achieved than that in the first embodiment, because the number of the touch-response-detection-signal-generating circuit 14 is reduced to that of notes in an octave, i.e., 12.

[C] OTHER VARIATIONS (1) In the above embodiments, the pressure detector 4 employs two stage response curves K1 and K2 that sharply change slopes thereof at the deflection point DP as shown in FIG.2, to detect both the initial-touch and after-touch. However, response curves applied to these embodiments are not limited to the one mentioned above. For example, a set of response curves with more than one deflection point can be used to produce multi-stage responses as initial-touch and after-touch information, resulting in effects similar to those described above.

(2) In the embodiments described above, the pressure detector 4 employs pressure-sensitive-resistance sheet 10 that uses pressure-sensitive ink. However, these embodiments can use other types of pressure-sensitive-resistance sheets that are made by spreading pressure-sensitive-resistance materials into sheet.

(3) In the above embodiments, the initial-touch-detection signal $S_{INI}$ and after-touch-detection signal $S_{AFT}$ are produced by using special hardware: initial-touch-signal-generating circuit 22 and after-touch-signal-generating circuit 27. However, these signals $S_{INI}$ and $S_{AFT}$ can be obtained by software that converts pressure-detection data S1 into data corresponding to signals $S_{INI}$ and $S_{AFT}$, resulting in the similar effects described above.

Although specific embodiments of a touch response device for an electronic musical instrument constructed in accordance with the present invention have been disclosed, it is not intended that the invention be restricted to either the specific configurations or the uses disclosed herein. Modifications may be made in a manner obvious to those skilled in the art. Accordingly, it is intended that the invention be limited only by the scope of the appended claims.

What is claimed is:

1. A touch response device for an electronic musical instrument provided with a plurality of keys for inputting performance information, comprising:

pressure detecting means for receiving applied pressure when a key is depressed and detecting an amount of pressure applied to said pressure detecting means, said pressure detecting means having at least first and second response stages that have different dynamic response characteristics to pressure variation and producing a key-operation-detection signal according to said response stages;

initial-touch-detection-signal-generating means for generating an initial-touch-detection signal when said pressure detecting means is in said first response stage; and after-touch-detection-signal-generating means for generating an after-touch-detection signal when said pressure detecting means is in said second response stage.

2. A touch response device for an electronic musical instrument as defined in claim 1, wherein said pressure detecting means comprises pressure-sensitive-resistance means for producing a touch-detection-signal in accordance with pressure and transmitting means for transmitting key pressure to said pressure-sensitive-resistance means, said pressure-sensitive-resistance means producing said initial-touch-detection signal of said first response stage by using contact resistance variation between said pressure-sensitive-resistance means and said transmitting means and producing said after-touch-detection signal of said second response stage by using resistance variation of said pressure-sensitive-resistance means.

3. A touch response device for an electronic musical instrument as defined in claim 1, wherein said pressure detecting means comprises:

pressure-sensitive-resistance means for varying resistance thereof in accordance with pressure exerted thereon, said pressure-sensitive-resistance means having first and second contact surfaces;

flexible electrodes provided on said first and second contact surfaces of said pressure-sensitive-resistance means to detect said resistance variance thereof;

holding means for containing said pressure-sensitive-resistance means and said flexible electrodes, said holding means being flexible and deformable when said key pressure is exerted thereon; and means for operatively connecting said key and said holding means.

4. A touch response device for an electronic musical instrument as defined in claim 3, wherein said holding means has a convex surface in contact with one of said electrodes, and said pressure-sensitive-resistance means is in the form of a sheet.

5. A touch response device for an electronic musical instrument as defined in claim 3, wherein said pressure-sensitive-resistance means comprises a sheet including pressure-sensitive ink.

6. A touch response device for an electronic musical instrument provided with a plurality of keys for inputting performance information, comprising:

pressure detecting means for receiving applied pressure when a key is depressed and detecting an amount of pressure applied to said pressure detecting means, said pressure detecting means having at least first and second response stages that have different dynamic response characteristics to pressure variation, said pressure detecting means producing a key-operation-detection signal according to said response stages, a plurality of said pressure detecting means being connected in a matrix that has row-input lines each of which designates an octave, and column-output lines each of which designates a note in an octave;

initial-touch-detection-signal-generating means provided for each column-output line, for generating an initial-touch-detection signal when said pressure detecting means is in said first response stage; and after-touch-detection-signal-generating means provided for each column-output line, for generating an after-touch-detection signal when said pressure detecting means is in said second response stage.

7. A touch response device for an electronic musical instrument provided with a plurality of operators for inputting performance information, comprising:

pressure detecting means for receiving applied pressure when an operator is operated and detecting an amount of pressure applied to said pressure detecting means, said pressure detecting means having at least first and second response stages that have different dynamic response characteristics to pressure variation and producing an operator-operation-detection signal according to said response stages;

initial-touch-detection-signal-generating means for generating an initial-touch-detection signal when said pressure detecting means is in said first response stage; and after-touch-detection-signal-generating means for generating an after-touch-detection signal when said pressure detecting means is in said second response stage.

* * * * *